US012781600B2

(12) United States Patent
Jacob

(10) Patent No.: US 12,781,600 B2
(45) Date of Patent: Nov. 3, 2026

(54) RETROFITTABLE DUAL FLOW PATH MANDREL

(71) Applicant: Saudi Arabian Oil Company, Dhahran (SA)

(72) Inventor: Suresh Jacob, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 153 days.

(21) Appl. No.: 18/741,317

(22) Filed: Jun. 12, 2024

(65) Prior Publication Data

US 2025/0382857 A1 Dec. 18, 2025

(51) Int. Cl.
*E21B 17/18* (2006.01)
*E21B 41/00* (2006.01)

(52) U.S. Cl.
CPC ..... *E21B 41/0042* (2013.01)

(58) Field of Classification Search
CPC ..... E21B 41/0035; E21B 17/18; E21B 43/14; E21B 17/203; E21B 41/0042
See application file for complete search history.

(56) References Cited

U.S. PATENT DOCUMENTS 3,224,267 A * 12/1965 Harlan ..... E21B 43/14 166/313
6,135,210 A 10/2000 Rivas
6,227,302 B1 5/2001 Pringle et al.
6,354,375 B1 * 3/2002 Dewey ..... E21B 23/12 166/241.1

(Continued)

FOREIGN PATENT DOCUMENTS

CA 2802988 10/2015
CA 2899222 1/2017

(Continued)

OTHER PUBLICATIONS

Abdel-Basset et al., "Chemical and Mechanical Water Shut-Off in Horizontal Passive ICD Wells; Experience and Lessons Learnt in Giant Darcy Reservoir," IPTC-20210-MS, International Petroleum Technology Conference (IPTC), presented at the International Petroleum Technology Conference, Dhahran, Saudi Arabia, Jan. 13-15, 2020, pp. 1-29, 29 pages.

(Continued)

*Primary Examiner* — Kipp C Wallace
(74) *Attorney, Agent, or Firm* — Dinsmore & Shohl LLP

(57) ABSTRACT

A combined rig and rigless deployed completion system includes a rig deployed dual flow mandrel arranged in a mandrel section of a pipeline. The dual flow mandrel includes a cylindrical mandrel body with a wall defining an interior volume, and a mandrel partition arranged in the interior volume. The mandrel body has a set of radial ports defined in the wall. The mandrel partition includes a barrel and at least two flanges. The barrel is concentrically arranged in the interior volume of the mandrel body and defines a central channel extending from the first end to the second end of the mandrel body. The flanges protrude radially from the barrel and extend longitudinally along an outer face of the barrel to contact the interior surface of the mandrel body. The barrel and the mandrel body define an annular space and the flanges partition the annular space into annular channels.

24 Claims, 13 Drawing Sheets

(56) References Cited

U.S. PATENT DOCUMENTS

| | | | | |
|---|---|---|---|---|
| 6,360,820 | B1 | 3/2002 | Laborde et al. | |
| 6,516,275 | B2 | 2/2003 | Lazaratos | |
| 6,549,879 | B1 | 4/2003 | Cullick et al. | |
| 6,684,956 | B1 | 2/2004 | Berry | |
| 6,931,324 | B2 | 8/2005 | Taner et al. | |
| 7,088,639 | B2 | 8/2006 | Walls et al. | |
| 7,108,067 | B2 | 9/2006 | Themig et al. | |
| 7,376,517 | B2 | 5/2008 | Rickett | |
| 7,555,389 | B2 | 6/2009 | Cavalca et al. | |
| 8,631,877 | B2 | 1/2014 | Gewily | |
| 9,031,820 | B2 | 5/2015 | Frederick | |
| 9,303,485 | B2 | 4/2016 | Hecker et al. | |
| 9,382,779 | B2 | 7/2016 | Dykstra et al. | |
| 9,506,325 | B2 | 11/2016 | Fould et al. | |
| 10,563,483 | B2 | 2/2020 | Steele | |
| 10,590,741 | B2 | 3/2020 | Van Der Veen et al. | |
| 11,725,485 | B2 | 8/2023 | Steele et al. | |
| 2001/0050172 | A1 | 12/2001 | Tolman et al. | |
| 2005/0000692 | A1 | 1/2005 | Cook et al. | |
| 2009/0326826 | A1 | 12/2009 | Hull et al. | |
| 2010/0097886 | A1 | 4/2010 | Day et al. | |
| 2011/0192602 | A1* | 8/2011 | Yeh | E21B 43/12 166/162 |
| 2012/0273236 | A1 | 11/2012 | Gandikota et al. | |
| 2012/0318579 | A1 | 12/2012 | Yang et al. | |
| 2014/0076560 | A1 | 3/2014 | Kenyon et al. | |
| 2014/0170025 | A1 | 6/2014 | Weiner et al. | |
| 2014/0360784 | A1 | 12/2014 | Hunziker et al. | |
| 2015/0168573 | A1 | 6/2015 | Zhang et al. | |
| 2015/0240598 | A1* | 8/2015 | Zhou | E21B 33/1285 166/305.1 |
| 2015/0267475 | A1 | 9/2015 | Marlow | |
| 2016/0091623 | A1 | 3/2016 | Yu et al. | |
| 2016/0178772 | A1 | 6/2016 | Carter | |
| 2017/0002625 | A1* | 1/2017 | Chochua | E21B 43/12 |
| 2017/0321547 | A1 | 11/2017 | Enkababian et al. | |
| 2019/0120048 | A1 | 4/2019 | Coffin et al. | |
| 2020/0332615 | A1 | 10/2020 | Wiesenborn et al. | |
| 2022/0298897 | A1 | 9/2022 | Al Sulaiman et al. | |
| 2023/0012112 | A1* | 1/2023 | Bruner | F15D 1/06 |

FOREIGN PATENT DOCUMENTS

| | | |
|---|---|---|
| CA | 2937384 | 6/2022 |
| EP | 1812683 | 4/2011 |
| WO | WO 2013044300 | 4/2013 |
| WO | WO 2014168617 | 10/2014 |
| WO | WO 2015110486 | 7/2015 |
| WO | WO 2018045255 | 3/2018 |
| WO | WO 2018104778 | 6/2018 |
| WO | WO 2018111103 | 6/2018 |
| WO | WO 2019099038 | 5/2019 |

OTHER PUBLICATIONS

Abubaker et al., "Technology Trial Review: Selective Coiled Tubing Re-Entry of Two Open Hole Multilateral Wells Using Intelligent Electromechanical Arm," SPE-182996-MS, Society of Petroleum Engineers, presented at the Abu Dhabi International Petroleum Exhibition & Conference, Abu Dhabi, UAE, Nov. 7-10, 2016, pp. 1-14, 14 pages.

Al-Khaldy et al., "First-Ever Level 4 Multilateral Well in North Kuwait Successfully Completed, Improves Oil Production," SPE-171792-MS, Society of Petroleum Engineers, presented at the Abu Dhabi International Petroleum Exhibition and Conference, Abu Dhabi, UAE, Nov. 10-13, 2014, pp. 1-12, 12 pages.

Arukhe et al., "Technology Evolution in a Giant Saudi Aramco's Field Development," WPC-21-0182, World Petroleum Congress (WPC), presented at the 21st World Petroleum Congress, Moscow, Russia, Jun. 2014, pp. 1-17, 17 pages.

Ertekin et al., "Artificial Intelligence Applications in Reservoir Engineering: A Status Check," Energies, Jul. 27, 2019, 12(2897):1-22, 22 pages.

Halliburton, "Halliburton Installs 400th FlexRite® System, Including Over 150 FlexRite MIC Junctions, in North Sea, Flexrite Mic Junctions Enable Advanced Control In Multilateral Completions," Halliburton, Case Study, 2022, pp. 1-2, 2 pages.

Halliburton, "IsoRite Isolated Multilateral Completion Systems: For Multilateral Wells that Require Re-Entry Capability to Access the Lateral, " Halliburton, Completion Solutions, Multilateral Systems, 2018, pp. 1-3, 3 pages.

Halliburton, "Operator Adds New Lateral to Existing Mainbore to Increase Reservoir Exposure and Reduce Overall Cost Per BOE, Multilateral Retrofit Installation Extends Production in Slot-Restricted Field," Halliburton, Case Study, 2021, pp. 1-2, 2 pages.

Halliburton.com [online], "Digital Twin Implementation for Integrated Production & Reservoir Management," 2018, retrieved on Sep. 27, 2019, retrieved from URL<https://www.ienergy.community/Portals/1/IenergyDocs/Marketing/DigitalTwin_Integrated_Reservoir_Production.pdf>, pp. 1-17, 17 pages.

Mohaghegh, "Reservoir simulation and modeling based on artificial intelligence and data mining (AI&DM)," Journal of Natural Gas Science and Engineering, Aug. 21, 2011, 3(6):697-705, 9 pages.

Saeed et al., "Multilateral Reentry System for Well Surveillance: Design, Implementation and Summary of 40 Jobs Performed in Fields," SPE-199849-MS, Society of Petroleum Engineers, presented at the SPE/ICoTA Well Intervention Conference and Exhibition, The Woodlands, Texas, Mar. 24-25, 2020, pp. 1-9, 9 pages.

Saumya et al., "Saturation Forecast Using Machine Learning: Enabling Smarter Decision-Making Capabilities," SPE-197419-MS, Society of Petroleum Engineers, presented at the Abu Dhabi International Petroleum Exhibition & Conference, Abu Dhabi, UAE, Nov. 11-14, 2019, pp. 1-10, 10 pages.

Schlumberger, "SLIC: Selective Lateral Intervention Completion System," Schlumberger, 2019, pp. 1-2, 2 pages.

slb.com [online], "Discovery MLT, Multilateral reentry system," available on or before Feb. 25, 2021, via Internet Archive: Wayback Machine URL<https://web.archive.org/web/20210225022742/https://www.slb.com/well-intervention/coiled-tubing-intervention/mechanical-intervention/discovery-mlt- multilateral-reentry-system>, retrieved on Sep. 12, 2024, URL<https://www.slb.com/well-intervention/coiled-tubing-intervention/mechanical-intervention/discovery-mlt-multilateral-reentry-system>, pp. 1-2, 2 pages.

Sudakov et al., "Artificial Neural Network Surrogate Modeling of Oil Reservoir: A Case Study," Springer International Publishing, Cham, Advances in Neural Networks—ISNN 2019, Jun. 26, 2019, 11555:232-241, 10 pages.

Vaferi et al., "Hydrocarbon reservoir model detection from pressure transient data using coupled artificial neural network—Wavelet transform approach," Applied Soft Computing, Jun. 4, 2016, 47:63-75, 13 pages.

Xindi et al., "Comprehensive Review of Water Shutoff Methods for Horizontal Wells," Petroleum Exploration and Development, Dec. 2017, 44(6):1022-1029, 8 pages.

* cited by examiner

RETROFITTABLE DUAL FLOW PATH MANDREL

TECHNICAL FIELD

This disclosure relates to mandrels installable in well completions, an in particular, mandrels that can accommodate riglessly deployable monitoring and control devices to convert passive completions to in advanced well completions.

BACKGROUND

Intelligent completions are completions that incorporate permanent downhole sensors and surface-controlled downhole interval control valves. Some intelligent completions can monitor, evaluate, and actively manage production (or injection) in real time either through wired, wireless or onboard intelligence. Data may be transmitted to surface for local or remote monitoring digital platform.

SUMMARY

A rigless completion system includes a pipeline and a dual flow mandrel arranged in the pipeline. The pipeline has a first section, a second section, and a mandrel section between the first section and second section. The dual flow mandrel is arranged in the mandrel section of the pipeline and includes a cylindrical mandrel body. The cylindrical mandrel body has a first end, a second end, a mandrel axis defined by the first end and the second end of the mandrel body, a wall extending from a first end to a second end of the mandrel body, and a set of radial ports. The wall has an interior surface defining an interior volume of the mandrel body. The set of radial ports are defined in the wall between the first end and the second end. The dual flow mandrel also has a mandrel partition arranged in the interior volume of the mandrel body. The mandrel partition includes a barrel and at least two flanges. The barrel is arranged on the mandrel axis and extends along the mandrel axis from the first end of the mandrel body to the second end of the mandrel body. The barrel has an inner face and an outer face. The inner face defines a central channel, and the central channel fluidly connects to the first section of the pipeline. The at least two flanges protrude radially from the barrel and extend longitudinally along the outer face of the barrel. The flanges contact the interior surface of the body. The outer face of the barrel and the interior surface of the body define an annular space and the at least two flanges partition the annular space into at least two annular channels.

In some systems, the at least two annular channels include a first annular channel and a second annular channel fluidically isolated from the first annular channel. The first annular channel can be aligned with the set of radial ports of the mandrel body and a second annular channel can be isolated from the radial ports of the mandrel body by the at least two flanges.

In some cases, the contact between the at least to flanges of the mandrel partition and the interior surface of the mandrel body forms a fluid seal.

In some embodiments, the inner surface of the mandrel body defines at least two grooves, each of the at least two grooves sized to receive a corresponding flange of the at least two flanges.

Some systems also include an inflow control device in the central channel of the mandrel partition. The inflow control device can be operable to control the flow of a fluid from the lateral wellbore opening. Some inflow control devices have a seal arrangement and at least one inflow control valve. The central channel of the mandrel partition can have a proximal end and a distal end. The inflow control device can fluidically isolate the proximal end of the central channel from the distal end of the fluid channel. In some systems, the central channel has an inflow section arranged between the proximal end and the distal end. The radial opening may be defined in the barrel aligns with the inflow region of the central channel. The inflow control device fluidically isolates the inflow section of the central channel from the distal end of the fluid channel. In some cases, the proximal end of the central channel fluidly connects to the first section of the pipeline.

Some systems also include a first packer and a second packer such that the mandrel section is defined between the first packer and second packer.

In some embodiments, the mandrel section is aligned with a lateral wellbore opening.

In some systems, the at least two flanges include a first flange, a second flange, a third flange and a fourth flange that each extend from the outer face of the barrel, and each extend longitudinally along the outer surface of the barrel from the first end to the second end of the barrel. The first flange, second flange, third flange, and fourth flange, may form at least four annular channels in the annular space of the dual flow mandrel. In some systems, the at least four channels include a lateral flow channel and a bypass flow channel. The set of radial ports in the wall of the mandrel body can fluidly connect the lateral flow channels to the environment external to the dual flow mandrel. In some cases, the lateral flow channel is fluidly connected to the central channel by the radial opening defined in the barrel. The bypass channel can fluidly connect the second section of the pipeline to the first section of the pipeline. The inner surface of the wall of the mandrel body can at least partially define the bypass channel is fluidically isolates the bypass channel from the environment external to the mandrel. The outer face of the barrel can at least partially define the bypass channel and fluidically isolate the bypass channel from the central channel. In some systems, the at least two flanges fluidically isolate the bypass channel from the lateral flow channel. In some cases, the set of radial ports is a first set of radial ports, further comprising a second set of radial ports defined in the wall of the mandrel body. The first set and second set of radial ports can be equidistant on the mandrel body, relative to each other. The barrel can also include a second radial opening aligned with the second set of radial ports of the mandrel body. In some systems, the second set of radial ports is fluidly connected to the central channel.

In some cases, the central channel fluidly connects the lateral wellbore opening to the first section of the pipeline.

In some cases, least two flanges are arranged equidistant around the outer face of the barrel.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

A downhole mandrel system has a passive mandrel defining two flow paths that guiding fluid flows from different sections of wellbores of a multi-segment or multi-lateral wellbore. The dual-flow mandrel can be operated as a passive, non-electrical completion and can be later retrofitted into an intelligent completion by rigless operation. By delaying installation of intelligent electronic equipment until the equipment is required or beneficial, the system can reduce degradation of the equipment from the hostile wellbore environments.

A rigless system with a retrofitted flow control device arranged in a passive a rigless deployed mandrel (device) is operable to control a lateral fluid flow from a multi-zonal wellbore. installed as a retrofittable completion in multi-lateral and multi-segment wells. The system can be initially deployed as a passive, dual flow mandrel, which can be subsequently retrofitted and transformed into a rigless deployed advanced completion ("intelligent completion"). The dual flow mandrel is a passive, non-electronic structure that defines at least one lateral flow channel and at least one bypass flow channel. The lateral flow channel (inflow channel, first channel, central channel) of the dual flow mandrel is fluidly connected to a lateral wellbore opening connected to a vertical (primary, main) wellbore. The lateral flow channel fluidly connects the lateral wellbore opening to the surface. A bypass channel (downhole flow channel, vertical flow channel, second channel) of the dual flow mandrel fluidly connects downhole regions in the vertical wellbore to the surface equipment.

When downhole monitoring and control is required or desired, a monitoring and/or control assembly, for example an inflow control device with downhole monitoring and inflow control valves, is installed in the lateral flow channel. The dual flow mandrel with the installed inflow control valve is operable to control the flow of the lateral fluid from the lateral wellbore while maintaining the flow of downhole fluid from the downhole region via the bypass channels.

This configuration can prevent or delay the installation of degradable electronics in wellbore that have a delayed or lengthy startup timeline (e.g., a multiyear delay between drilling and production startup). The system can also be used in wells that require downhole monitoring and control after a period of time and after installing the passive completion with the dual flow mandrel. The passive, dual flow mandrel contains no initial electronics and is sized to receive intelligent electronics installed through a rigless. The dual flow mandrel can facilitate riglessly deployed, retrofittable advanced completions which may reduce capital expenses, while improving reliability of assets, delaying workover, and increasing production.

Figure 1:
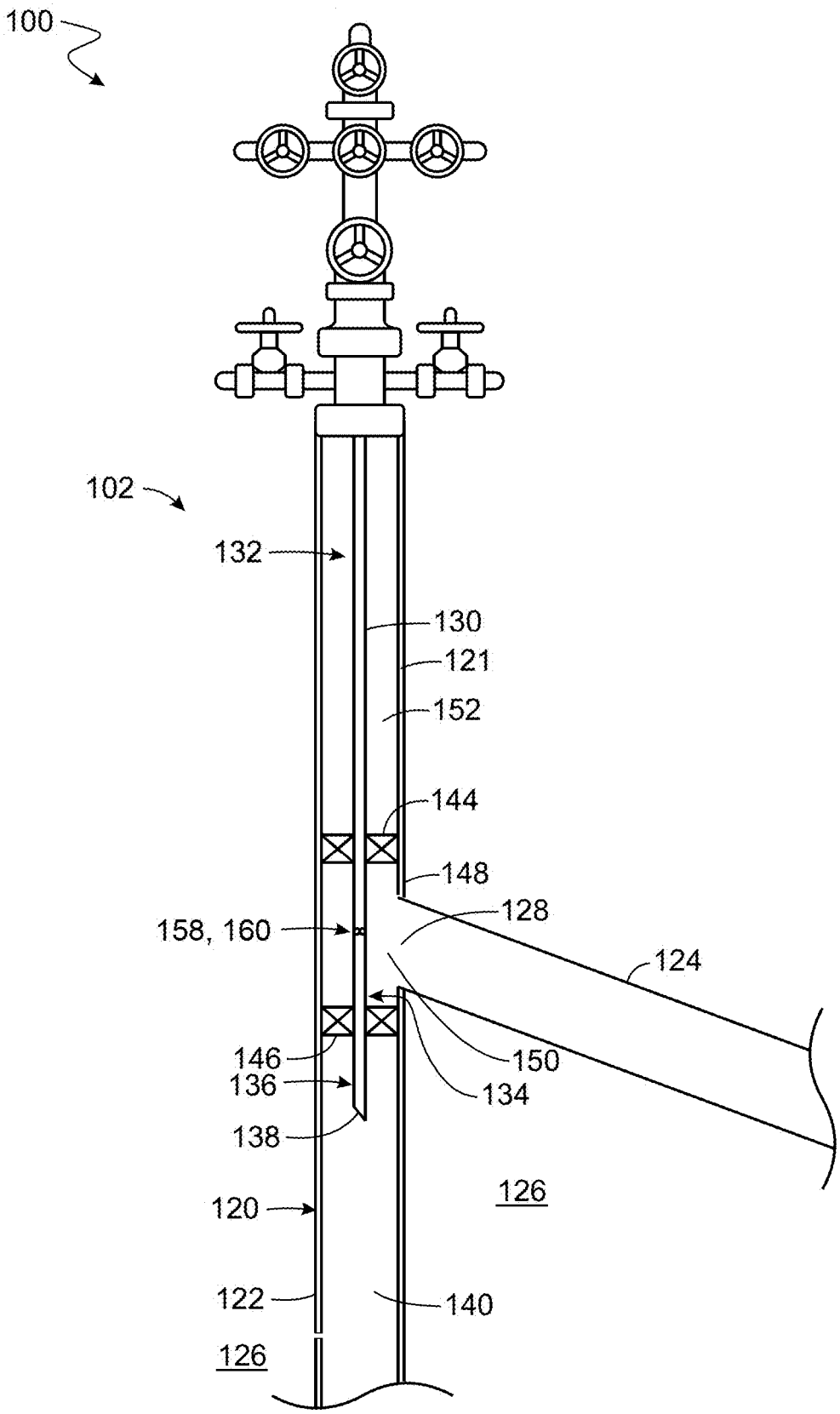
FIG. 1 is a view of a multizone, rigless system with a passive dual flow mandrel.

FIG. 1 is a view completion system 100 with a Christmas tree apparatus 110 atop a multizone, wellbore 120 lined with a casing 121. The multizonal wellbore 120 includes a main (vertical) wellbore 122 and a lateral wellbore 124. The lateral wellbore 124 extends into a formation 126 at an angle relative to the vertical wellbore 122. An opening 128 of the lateral wellbore 124 is defined in a wall (e.g., a side of the vertical wellbore 122.

The deployed completion system 100 includes a pipeline 130 connected to a Christmas tree apparatus 110. The pipeline 190 extends into the vertical wellbore 122. The pipeline 130 has a first (uphole) section 132, a mandrel (middle) section 134, and a second (downhole) section 136. The mandrel section 134 is arranged between the uphole section 132 and the downhole section 136 of the pipeline 130. The uphole section 132 currently to the Christmas tree apparatus 110 and the downhole section 136 terminates at an open end 138 (e.g., pipeline inlet, pipeline outlet) of the pipeline 130. The pipeline opening 138 is fluidly connected to a downhole region 140 of the wellbore 122. During production operations, fluid flows from the formation 126 into the downhole region 140, and then into the open end 138 of the pipeline 130.

The system 100 also includes a first packer 144 and a second packer 146 arranged in the vertical wellbore 122. The first packer 144 is arranged uphole of the lateral wellbore opening 128 and the second packer 146 is arranged downhole of the well bore opening 128. In this configuration, the lateral wellbore opening 128 defined in the wall 148 of the vertical wellbore 122 is located between the first and second packers 144, 146. The first and second packer 144, 146 define a mandrel region 150 of the wellbore 120. The mandrel section 134 of the pipeline 130 is arranged in the mandrel region 150 of the wellbore 120. The mandrel region 150 of the wellbore 120 is fluidly connected the lateral wellbore 124, by the wellbore opening 128. In some cases, the mandrel region is or includes an isolated annulus defined at least between the mandrel section, the first packer, the second packer, and the casing. The isolated annulus can be fluidly connected to the lateral wellbore opening.

The first packer 144 and the casing 121, define an uphole region 152 of the wellbore 122. The first packer 144 isolates the uphole region 152 from the mandrel region 150. The second packer 146 isolates the mandrel region 150 from the downhole region 140.

The system 100 includes a passive (e.g., non-electronic) dual flow mandrel 158. The dual flow mandrel 158 is a partitioned mandrel 160 integral with, connected to, or arranged in the mandrel section 134 of the pipeline 130. The partitioned mandrel 160 guides and maintains separation between a downhole fluid stream from the downhole region 140 and a lateral fluid stream from the lateral wellbore 124. The partitioned mandrel 160 is sized to receive intelligent completion equipment (e.g., an electronic inflow control valve) to control the lateral flow stream without altering, controlling, and/or reducing the downhole fluid stream. For example, upon determining that the lateral wellbore 124 has a water cut above a predetermined threshold, a control inflow device (FIG. 6) can be run in and installed in the partitioned mandrel 160. The retrofitted, intelligent partitioned mandrel 160, with a control inflow device (FIG. 7B), can control, limit, or eliminate the lateral fluid stream while the downhole stream remains unaffected or by the control inflow device.

Figure 2:
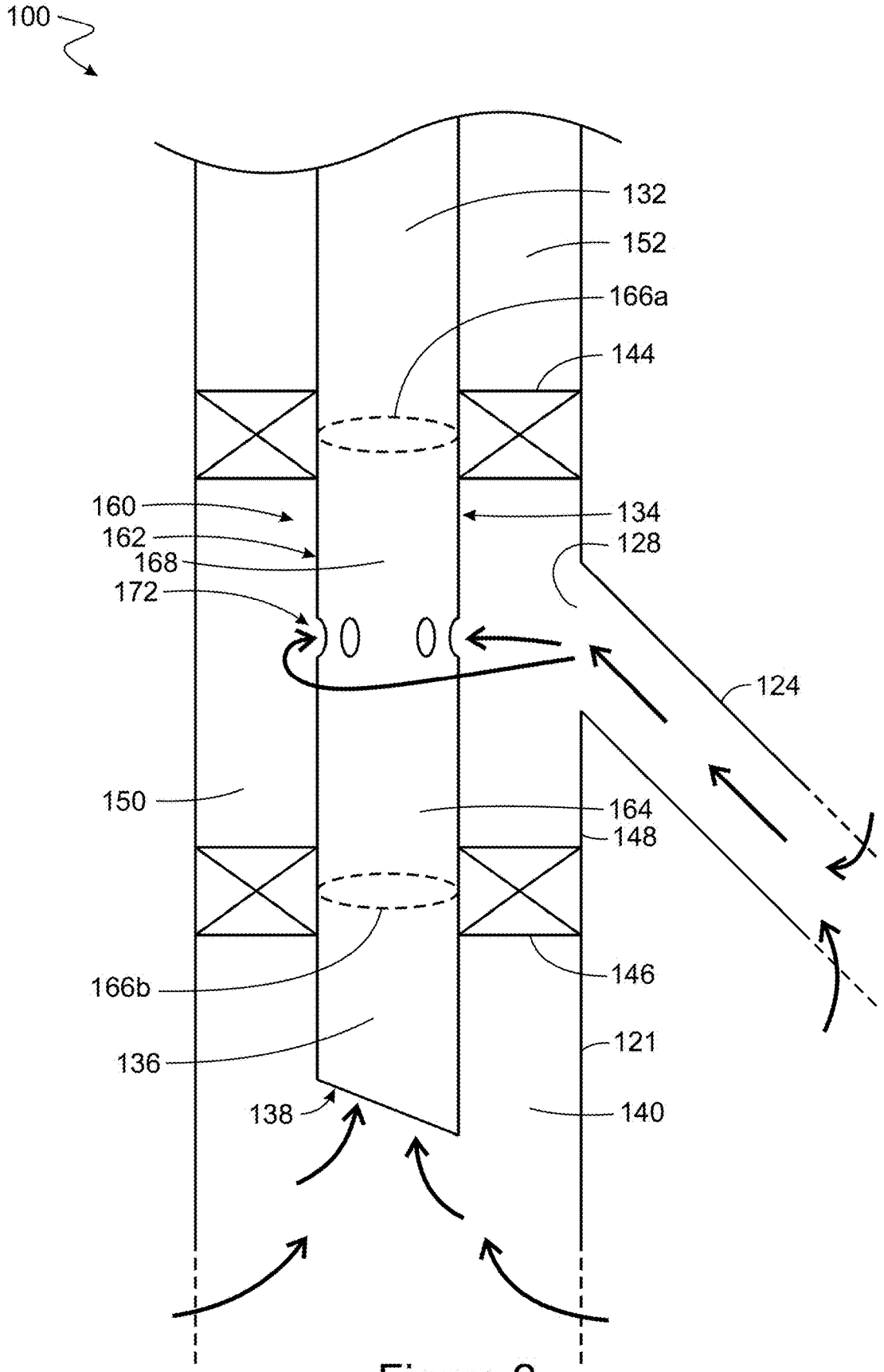
FIG. 2 is a front view of a partitioned dual flow mandrel deployed in a wellbore.
Figure 3:
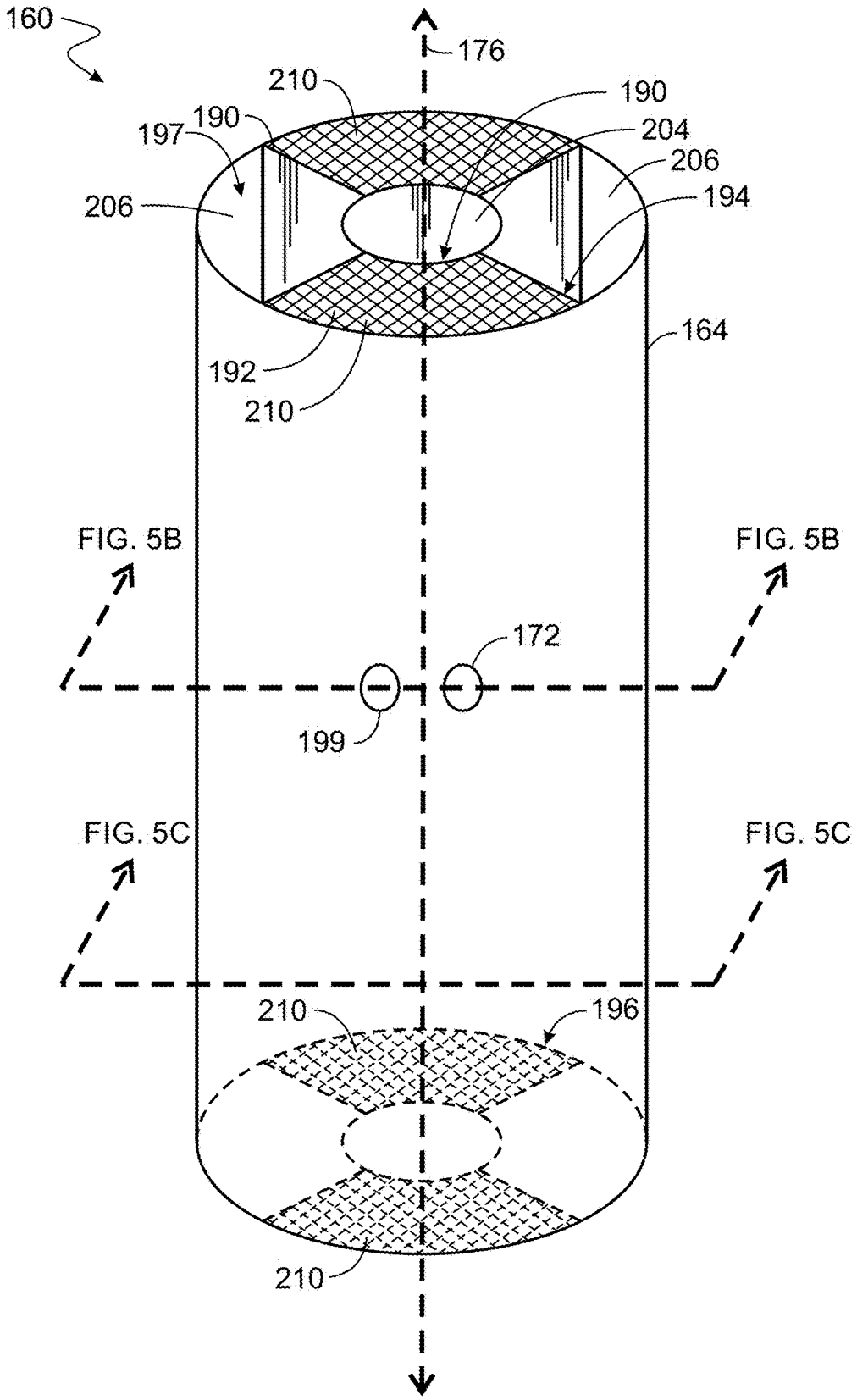
FIG. 3 is a cross sectional view of the partitioned dual flow mandrel having a partition arranged in a cylindrical body.

FIG. 2 is a front view of a partitioned dual flow mandrel 160 deployed in the mandrel region 150 of the wellbore 120. The partitioned mandrel 160 includes a mandrel body 162 with a wall 164. The mandrel body 162 has a first end 166*a* (proximal end, uphole end) to a second end 166*b* (distal end, downhole end). The wall 164 extends from the first end 166*a* to the second end 166*b*. The wall 164 has an exterior face 168 and an interior surface 170 (FIG. 3).

The wall 164 defines sets or clusters of radial ports 172. The radial ports 172 extend through the wall 164 and fluidly connect the mandrel region 150 (e.g., the environment external to the mandrel section 134 of the pipeline 130) to an interior volume 173 at least partially defined by the interior surface 170. The interior volume 173 extends from the first end 166*a* to the second end 166*b* of the mandrel body 162. The mandrel body 162 defines a mandrel (central) axis 176.

The cluster of radial ports 172 are arranged in a close formation of radial ports 172*a* at an axial location between the first end 166*a* and the second end 166*b* of the mandrel body 162. The mandrel 160 has a first cluster of radial ports and a second cluster of radial ports. The first and second cluster of ports are arranged equidistant around the axis 176. The first and second clusters of radial ports 172 are arranged at the same axial location on the wall 164, however, some clusters may be arranged at different axial locations along the wall 164. In some dual flow mandrels, the mandrel body includes at least one clusters of radial ports, for example, one, three, four, or five clusters each arranged equidistant around the axis.

In use, the clusters of radial ports 172 align or are arranged adjacent to the opening of the lateral wellbore 124. Lateral fluid flowing from the opening 128 of the lateral wellbore 124 enter the mandrel 160 through radial ports 172*a* of the clusters 172. The radial ports 172*a* each extend through the wall 164, perpendicular to the mandrel axis 176. Downhole fluid from the downhole region 140 enters the mandrel via the open end 138 and second section 136 of the pipeline 130.

FIG. 3 is a perspective view of the partitioned dual flow mandrel 160 with a partition 188 arranged in the cylindrical mandrel body 162. The partition 188 includes four flanges 190 (e.g., at least two flanges), a barrel 192, a first cap 194, and a second cap 196. The partition 188 divides the interior volume 173 of the mandrel body 162 into multiple channels. Some of the formed channels are isolated from each other whereas other formed channels are interconnected by radial openings 199 defined in the barrel 192 of the partition 188. The partition 188 fluidly connects the lateral wellbore opening 128 to the first section 132 of the pipeline 130 and, separately, connects the downhole region 140 of the vertical wellbore 122 to the first section 132 of the pipeline 130. The lateral fluid and the downhole fluid merge and mix at the first section 132 of the pipeline 130. In some cases, the first section of the pipeline maintains the separation between the downhole fluid and the lateral fluid.

The partition 188 includes the cylindrical barrel 192 arranged on the mandrel body axis 176. In some cases, the cylindrical barrel defines a partition axis which can be parallel to or aligned with the mandrel body axis. The barrel 192 is concentrically arranged within the mandrel body 162. The barrel 192 extends along the mandrel axis 176 from a first end 198*a* of the barrel to a second end 198*b* of the barrel. The first end 198*a* of the barrel 192 aligns with the first end 166*a* of the body 162. The second end 198*b* of the barrel 192 aligns with the second end 166*b* of the body 162.

The barrel 192 has an inner face 200 and an outer face 202. The inner face 200 defines a central channel 204. The central channel 204 fluidly connects the first section 132 of the pipeline 130 to the mandrel region 150 and lateral wellbore opening 128. The outer face 202 of the barrel 192 and the interior surface 170 of the body 162 define an annular space 197. The flanges 190 partition the annular space 197 into four annular channels (at least two annular channels). In the mandrel 160, the four flanges 190 divide the annular space 197 into four fluidically isolated channels that extend longitudinally within the annular space, parallel to the mandrel body axis 176. The four annular channels include two bypass channels 206 and two inflow channels 208. The inflow channels 208 align with radial opening 199 of the mandrel body 162 and the radial clusters 172 in the wall 164. The inflow channels 208 fluidly connect an aligned cluster of radial ports 172 with the radial opening 199 in the barrel 192 or the partition 188. In this configuration, the lateral wellbore opening 128, the mandrel region 150, the cluster of radial ports 172, the inflow channels 208, the radial opening 199, and the central channel 204 are fluidly connected. The central channel 204 is sized to receive intelligent completion equipment to retrofit the wellbore completion into an intelligent wellbore completion. For example, the central channel 204 is sized to receive an inflow control device (FIG. 6) which can control (e.g., by opening or closing a valve) the fluid connection between the central channel 204 and the inflow channel 208.

The central channel 204 of the partition 188 is arranged concentrically within the annular space 197 such that the annular space 197 and central channel 204 are arranged on the mandrel body axis 176. The central channel 204 also fluidly connects the downhole region 140 when the dual flow mandrel 160 is in a passive configuration (e.g., has no intelligent completion equipment mounted in the mandrel). When intelligent completion equipment is inserted into the mandrel 160, for example to retrofit the wellbore completion into an intelligent completion (FIG. 7B), the intelligent equipment mounted in the central channel 204 seals the central channel 204 from fluid connection with the downhole region 140.

The first and second caps 194, 196 include covers 210 that extend across the annular space 197 to cover the inflow channels 208. In use, the bypass channels 206 are exposed at the ends of the channel 206 and the inflow channels 208 are covered or capped at the ends of the channel 208. In this configuration, fluid flowing the in the bypass channels 206 exits and enters the bypass channels 206 at the first and second ends 166*a*, 166*b* while fluid flowing in the inflow channels 208 enters through the cluster of radial ports 172 and exits inflow channel 208 via the radial openings 199 of the barrel 192. The flanges 190 isolate fluid flowing in each annular channel 206, 208 from adjacent annular channels (e.g., channels that are at least partially defined by the same flange). The inflow channels 208 flow and guide fluid derived or sourced from the lateral well 124 connected to the mandrel region 150. The bypass channels 206 flow and guide fluid sourced from vertical wellbore 122 connected to the downhole region 140.

Figure 4A:
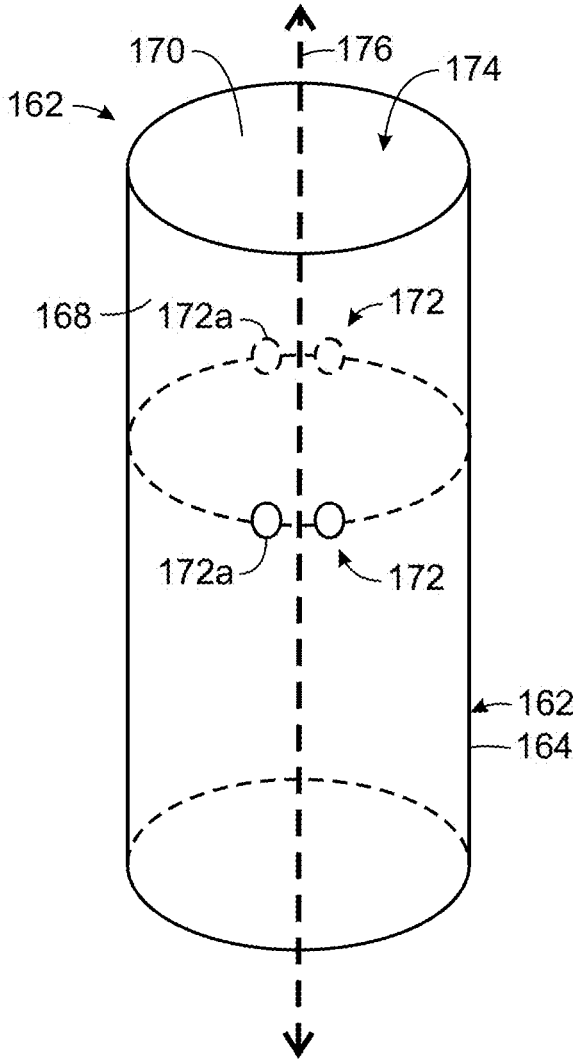
FIG. 4A is a perspective view of a mandrel body of the mandrel.
Figure 4B:
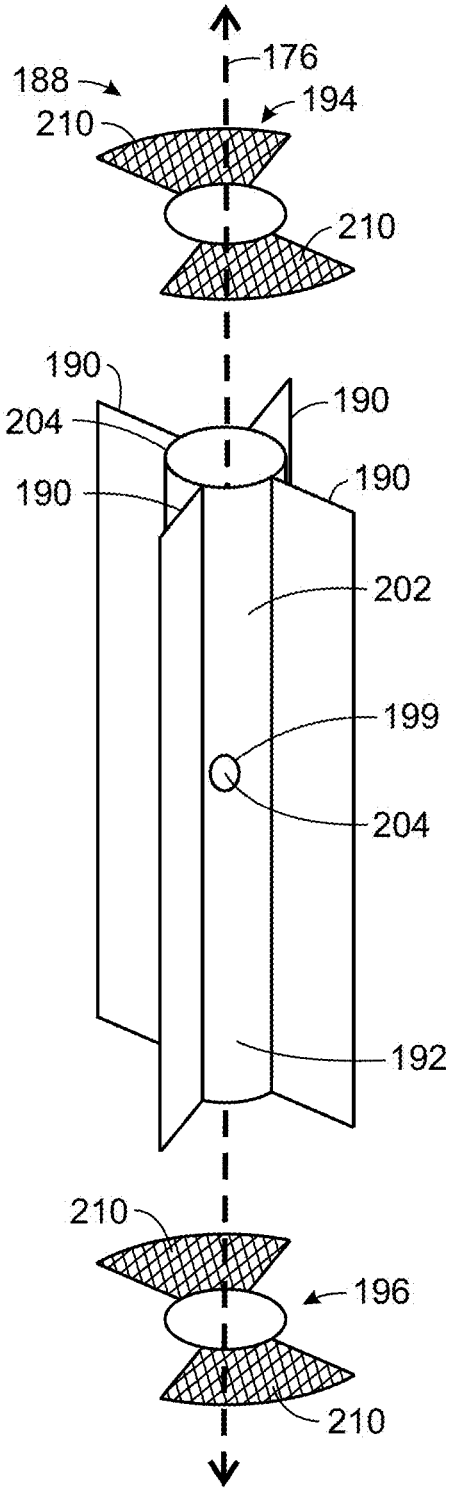
FIG. 4B is an exploded, perspective view of a partition of the mandrel.

FIGS. 4A and 4B show a perspective view of the mandrel body 162 and a perspective exploded view of the mandrel partition 188, respectively. The mandrel body can include or define longitudinal grooves on the interior surface for engaging the flanges and rotationally constraining the partition to the mandrel body.

The multiple flanges 190 protrude radially from the barrel 192 and extend longitudinally along the outer face 202 of the barrel 192. The flanges 190 contact the interior surface 170 of the body 162 and form a seal between the flange 190 and interior surface 170 of the mandrel body 162. The connection between the flanges 190 and the interior surface 170 of the body 162 forms fluidically isolated annular channels (e.g., bypass channels and inflow channels) within the annular space 197. The flanges 190 are integrally formed with the barrel 192, however, some flanges may be connected to the barrel and/or interior surface of the body by a groove or slot connection. This configuration can reduce or prevent rotation between the partition and mandrel body in use.

Figure 5A:
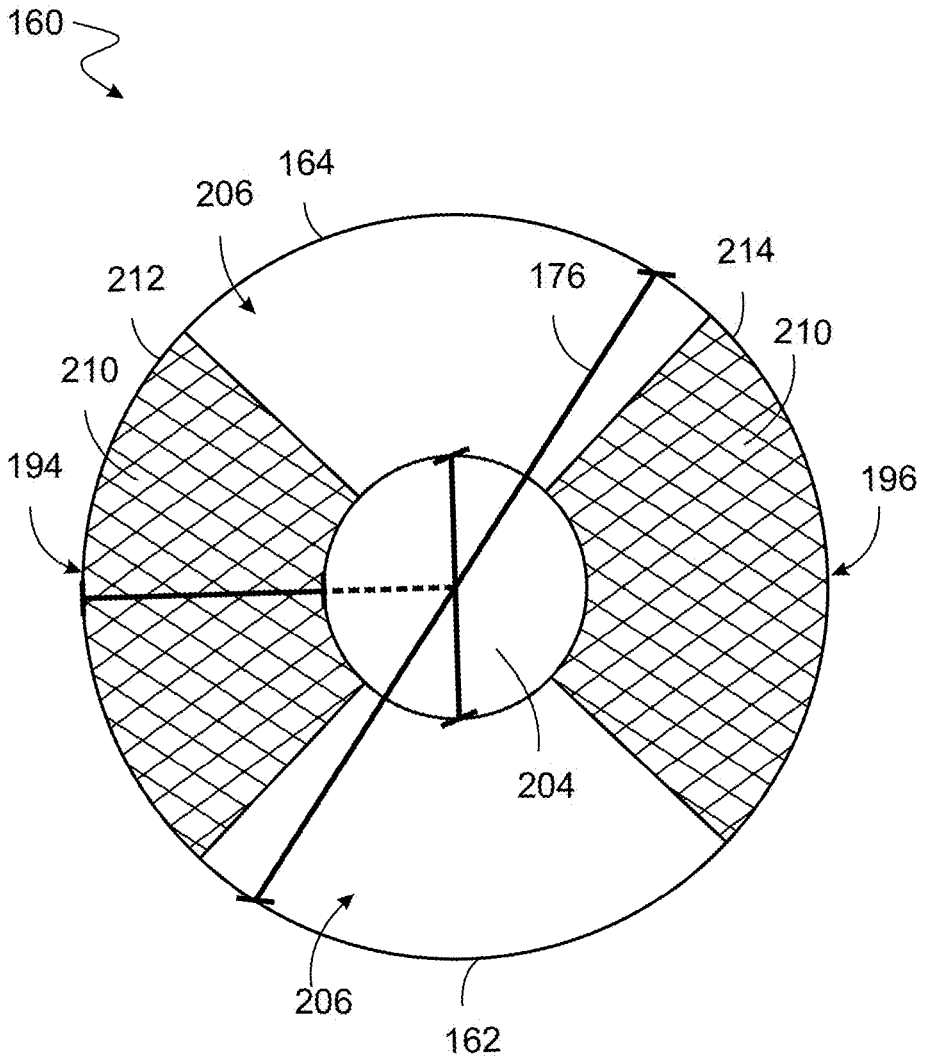
FIG. 5A is a top view of the partitioned mandrel.

FIG. 5A is a top view of the partitioned mandrel 160. The first cap 194 is mounted to the first end 166*a* of the mandrel body 162. The first cap 194 includes covers 210 (first and second seals) sized to cover a cross section of an annular inflow channel 208. The first cap includes a frame 212 that connects the first cap 194 to the mandrel body 162. The shape of the frame 212 corresponds to the cross-sectional profile of the mandrel 160. The frame 212 defines an aperture 214 centered on the mandrel axis 176 and aligned with the central channel 204. The diameter of the aperture 214 of the frame 212 is about equal to a diameter of the central channel 204 and/or the barrel 192 of the partition. 188. The frame can also mount to the first end of the barrel and/or the flanges of the partition. The second cap 196 is also includes a frame 212, with an aperture 214, and covers 210. The second cap 196 is similarly mounted to the second end 166*b* of the mandrel body 162. (FIG. 3).

The caps 194, 196 are rigidly fixed to the mandrel body 162, for example, by welding. The attached caps 194, 196 force annular flow entering the mandrel body 162 via the ports 172, to flow through the radial openings 199 and into the central channel 204. Together, the first cap 194 and the second cap 196 block the flow of fluid into the inflow channel 208 from the first end 166*a* of the mandrel body 162 and from the second end 166*b* of the mandrel body 162.

Figure 5B:
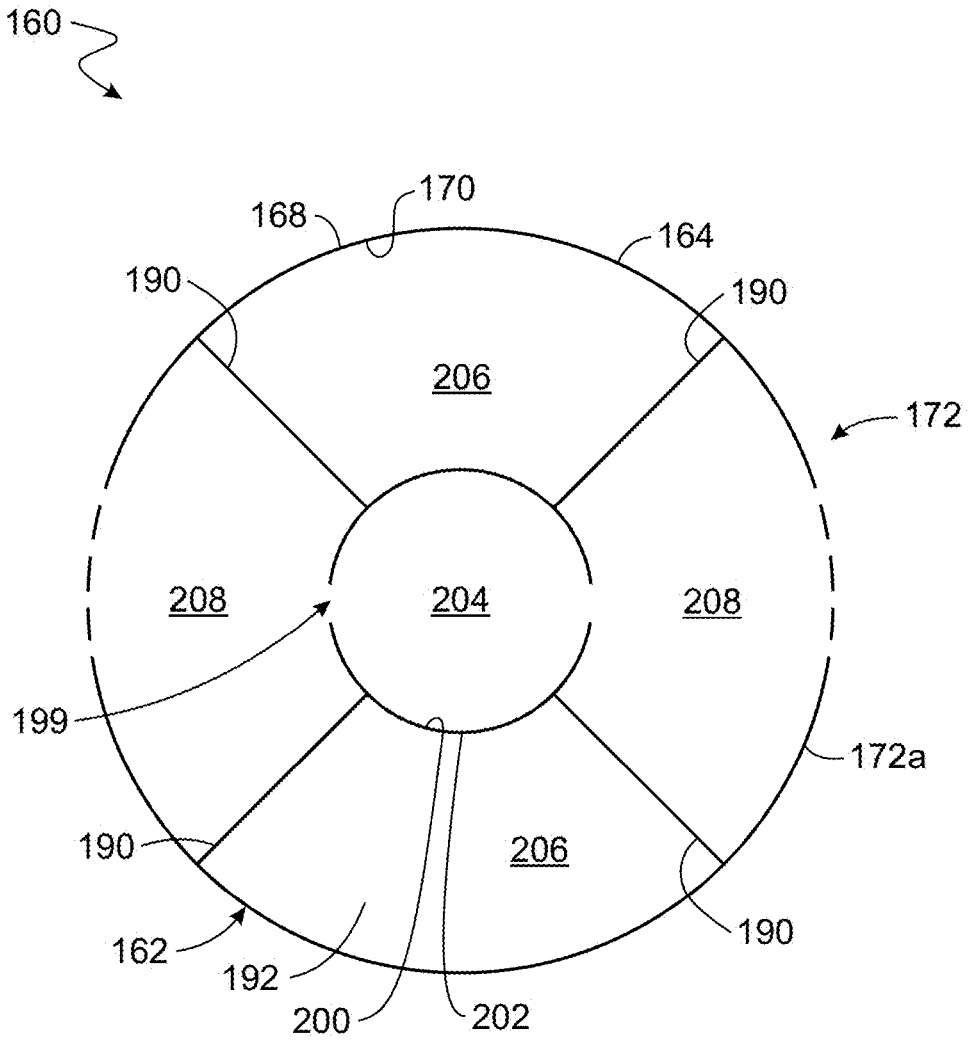
FIGS. 5B and 5C are cross sectional views of the mandrel.

FIG. 5B is a cross sectional top view of the partitioned dual flow mandrel 160 with the clusters of radial ports 172 of the body 162 aligned with the radial openings 199 of the barrel 192 of the partition 188. The bypass channels 206 are isolated from the radial openings 199 and clusters of radial ports 172 by the flanges 190. The bypass channels 206 are defined by unitary portions of the wall 164 (e.g., portions of the walls without clusters of radial ports). The bypass channels 206 are also defined by unitary portions of the barrel 192 (e.g., portions of the barrel without radial openings). The inflow channels 208 are defined by portions of the wall 164 in which the clusters are defined and by portions of the barrel 192 in which the radial openings 199 are defined. While the mandrel 160 has the clusters of the radial ports 172 and the radial openings 199 arranged at the same or similar axial (longitudinal) position, some mandrels can have clusters of radial ports and radial openings that are longitudinally and/or radially askew relative to each other, so long as the radial and ports fluidly connect by the same inflow channel.

Figure 5C:
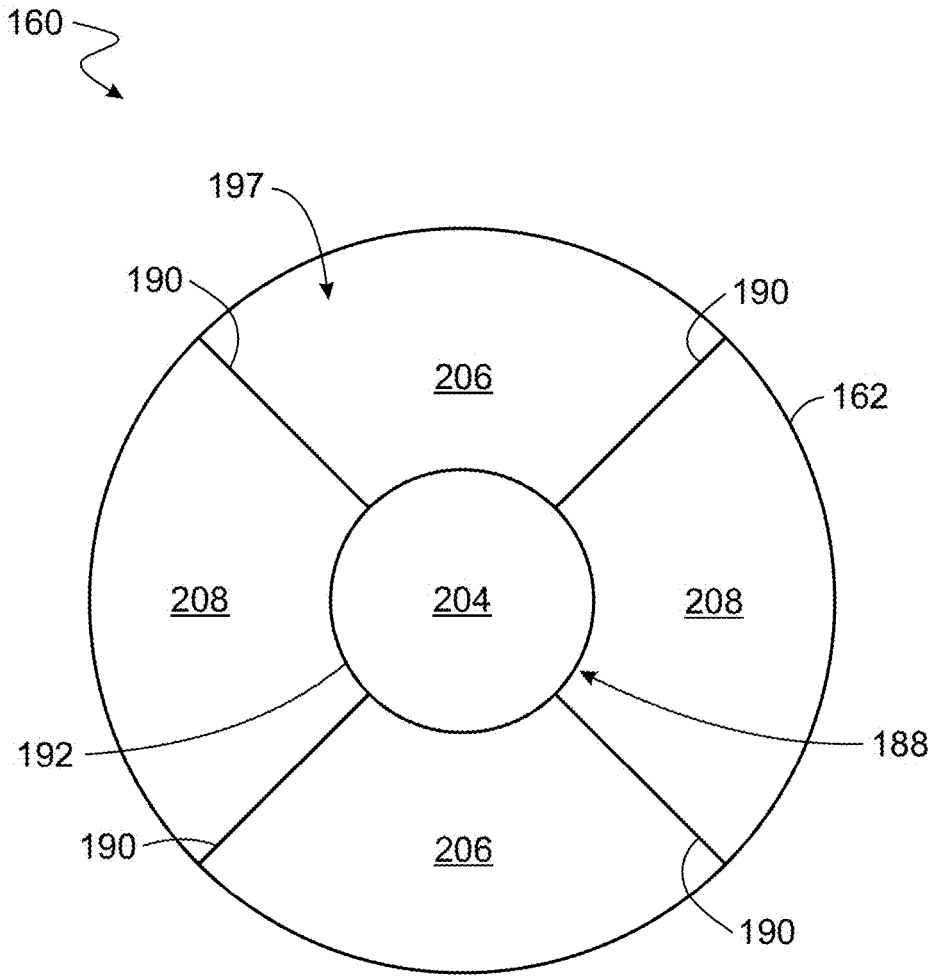

FIG. 5C is a cross sectional view of the partitioned dual flow mandrel 160 with a central channel 204 and annular channels (e.g., bypass channels 206 and inflow channels 208) separated by the flanges 190. The central channel 204 is defined by the inner face 200 of the barrel 192. At axial (longitudinal) locations uphole or downhole of the aligned radial clusters 172 and radial openings 199, the walls of the mandrel body 162, the barrel 192, and the flanges 190 define and isolate the annular channels relative to each other. The four annular channels are each bound by the interior surface 170 of the body 162, the outer face 202 of the barrel 192, and the four flanges 190.

Figure 6:
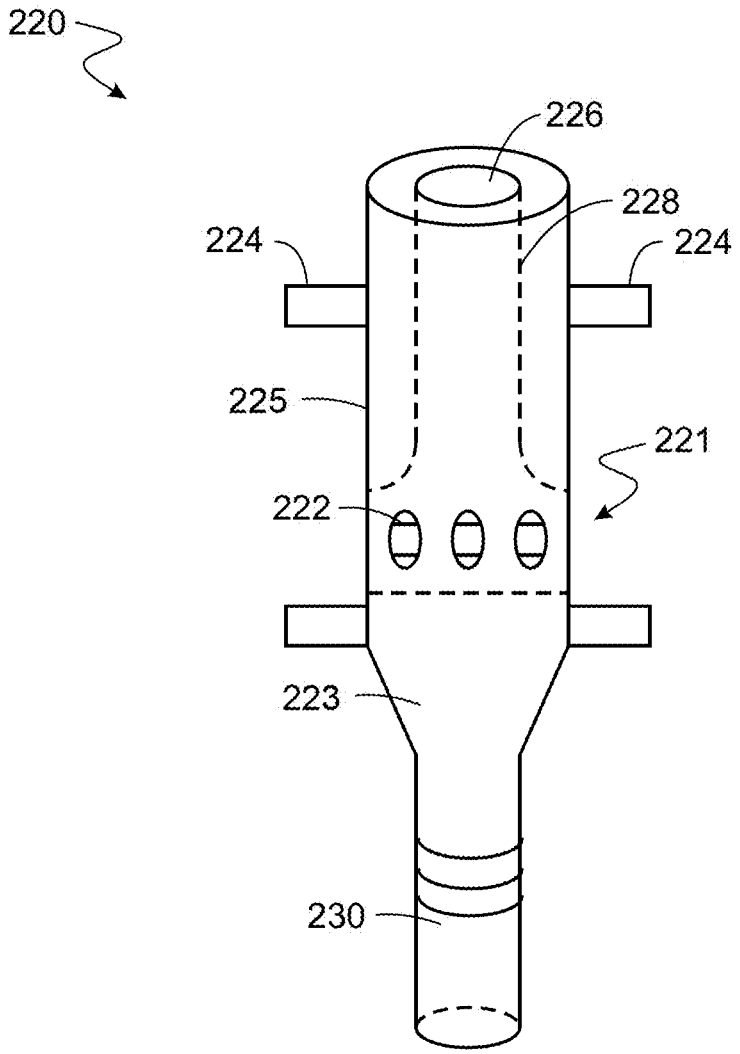
FIG. 6 is a perspective view of the inflow control device having control valves and a seal arrangement.

FIG. 6 is a perspective view of riglessly deployed equipment for retrofitting the completion system 100 into an intelligent completion system. The riglessly deployed equipment includes a riglessly deployed downhole fluid sensing and control assembly ("installable assembly") 220 operable to monitor and control the inflow from the annulus of the mandrel region of the wellbore. The installable assembly 220 includes an inflow control device 221. In some systems, the installable assembly is an inflow control device.

The installable assembly 220 has a body 223 defining or housing control valves 222 and a seal arrangement 224 arranged on or integral with an exterior 225 of the body. The control valve ports 222 are arranged between at least two seals of the seal arrangement. In some cases, the sealing arrangement is separate from and mountable to the exterior of the body. The control valves 222 are powered by a battery 230 arranged in a plug region 231 (a housing section) of the body 223 of the installable assembly 220. A control module or computer subsystem can also be arranged in the plug region to control the battery, control the valves, receive signals from a sensor arrangement, and/or receive signals from a connect computer system at the surface. The plug region 231 of the body 223 is arranged in the central channel 204. The plug 231, alone or with the sealing arrangement 224, forms a fluid barrier. The fluid barrier prevents fluid from the downhole section 146 of the pipeline 120 from flowing though the central channel 204. In some cases, a downhole power generator may be integrated with the installable assembly to charge the battery.

The control valves of the installable assembly 220 are operable to open, partially close, and close when prompted by a received signal (e.g., a command). The signal may be transmitted from a connected computer sub-system or by an integral computer sub-system of the installable assembly. The computer sub-system may be connected to a sensor arrangement of the installable assembly, for example a water and/or gas sensor mounted to the exterior of the body of the installable assembly. The computer sub-system can include a controller; one or more processors, and a non-transitory computer-readable medium storing instructions executable by the one or more processors to perform operations. The computer sub-system may be operably connected to the sensing arrangement, the battery, and/or the installable assembly. The operations can include receiving a signal from the sensor arrangement and prompting the valves to open, close, partially open, or partially close based on the received signals from the sensor arrangement. For example, the processor may prompt the valves to close or partially close when the water sensors sense a threshold water cut of the fluid entering the installable assembly.

The body 223 of the installable assembly 220 defines an outlet 226 fluidly connected to the control valves 222 by an internal (narrow) fluid path 228 in the installable assembly. The outlet 226 is fluidly connected to the first section 132 of the pipeline 190. In this configuration, the valves ports 222 of the installable assembly 220 control the fluid connection between the first section 132 of the pipeline 130 and the central channel 204 of the mandrel 160 The control valves 222 are powered by the battery 230 arranged in the installable assembly 220.

The installable assembly 220 is insertable into the central channel 204 (FIG. 3) by rigless intervention, for example using coil tubing, slickline or e-line, after production operations in the wellbore 120 have commenced and when downhole monitoring and inflow control is desired. The installable assembly is operable to control or terminate the flow from the lateral wellbore 124, for example when a water cut threshold is reached. By delaying the installation of the installable assembly, the delicate and degradable electronics of the installable assembly 220 are not exposed to hostile (degrading) wellbore environments until the utility (e.g., the need to control a flow) of the installable assembly is required. As such, this system can extend the life of the installable assembly by reducing environmental damage incurred by the installable assembly and any other installable (e.g., retrofittable) electronics.

The installation of the installable assembly 220, including the inflow control device 221 and/or other installable electronic devices, can retrofit the completion 100 into an "intelligent completion" 100 capable of monitoring and controlling fluid flow into the pipeline 190. The completion system 100 with a dual flow mandrel 158 retrofitted with monitoring and control devices (e.g., the installable assembly and/or inflow control devices) is an intelligent completion system 100 operable to control and monitor fluid flow from the mandrel region 150 of the wellbore while the fluid from the downhole region 148 a is maintained (e.g., is not controlled by the newly installed assembly 220).

Figure 7A:
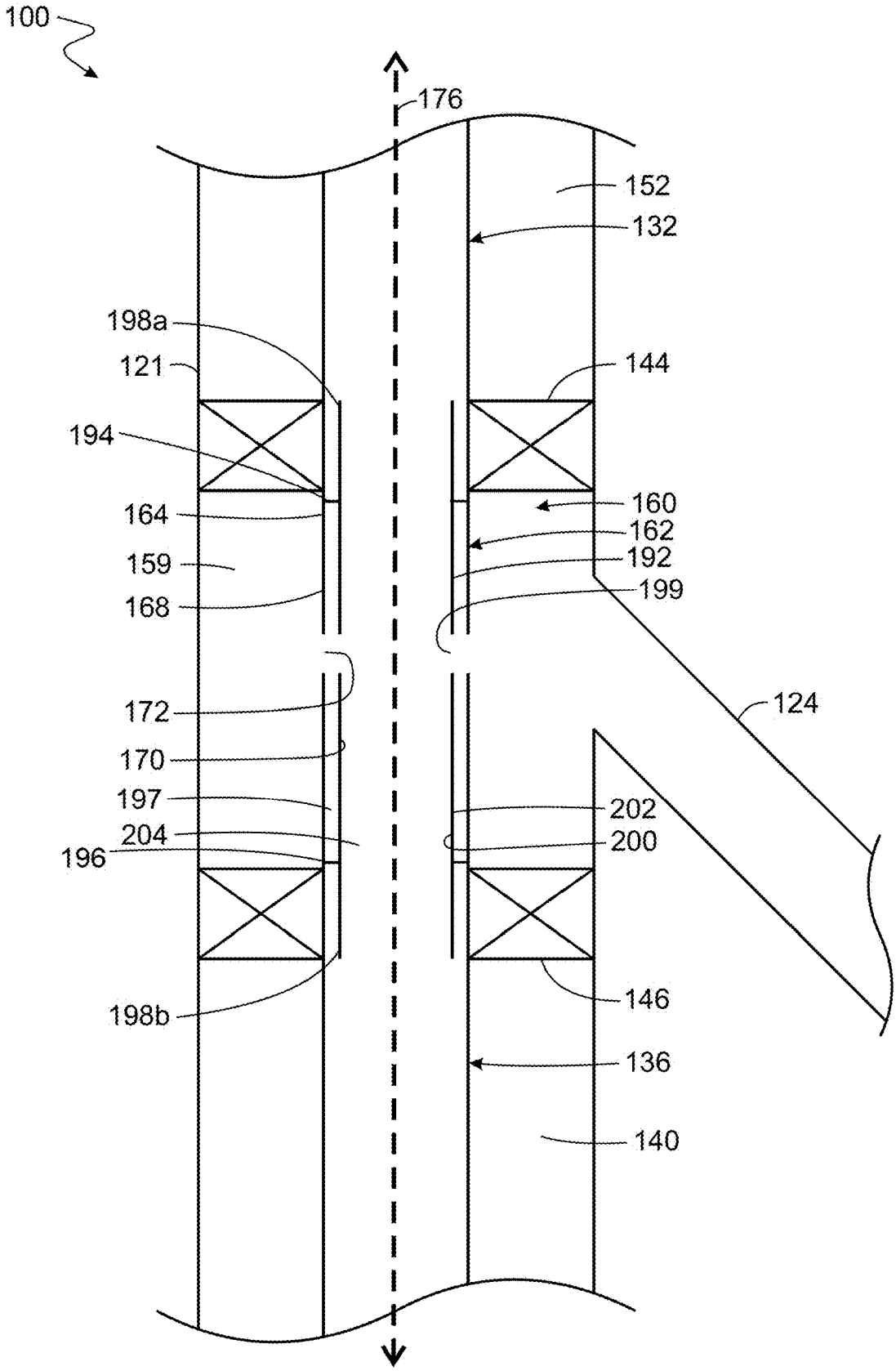
FIG. 7A is a cross sectional view of a partitioned dual flow mandrel deployed in a wellbore.
Figure 7B:
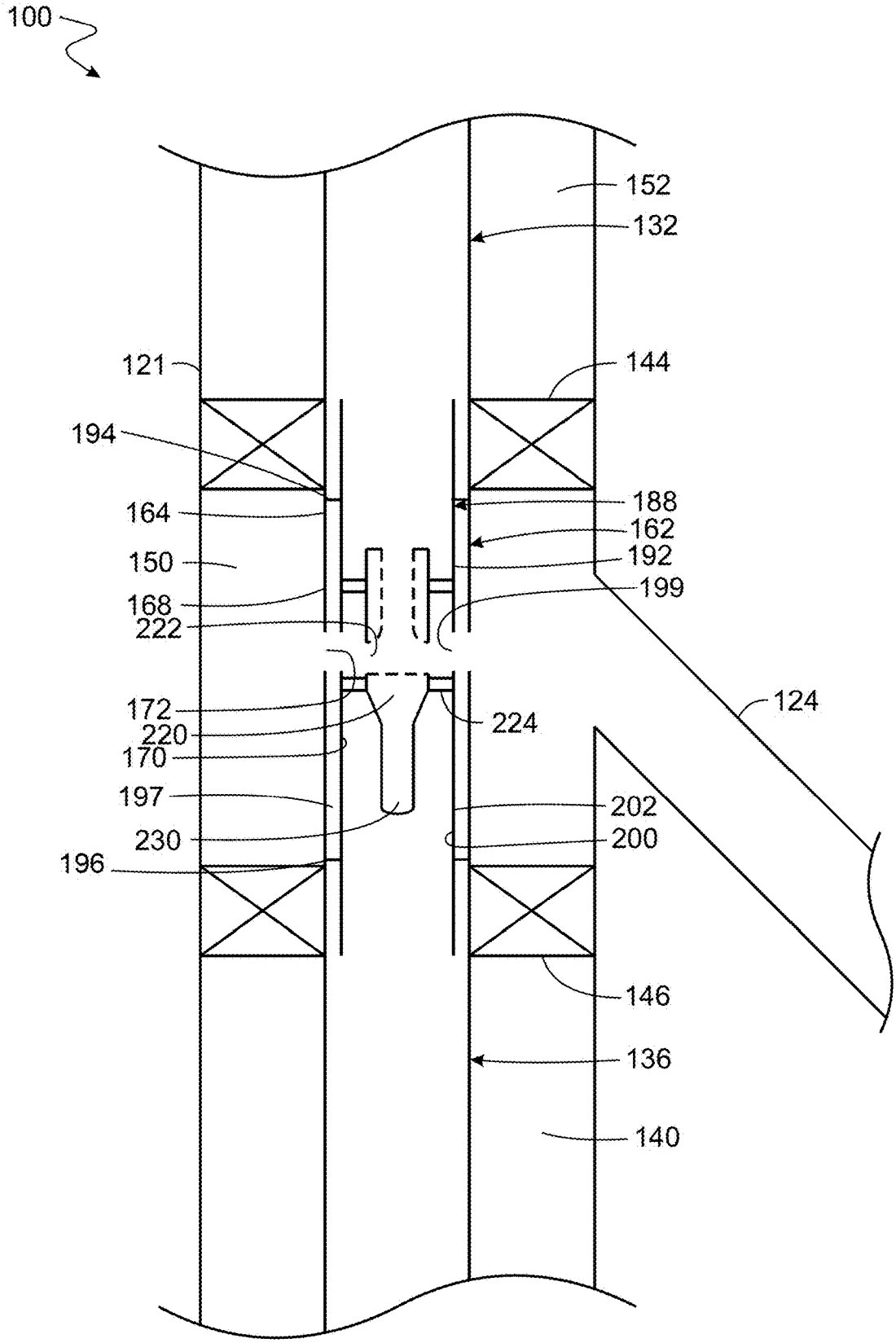
FIG. 7B is a cross sectional view of the inflow control device mounted in the central channel of the bypass dual flow mandrel.

FIGS. 7A and 7B are cross sectional front views of the system 100 prior to installation of the installable assembly 220 into the mandrel 160 (e.g., the passive or mechanical completion) and after installation of the installable assembly 220 in the central channel 204 of the mandrel 160 (e.g., the retrofitted, intelligent completion). The inflow control device 221 of the installable assembly 220 is installed when the operator or a connected system determines that lateral fluid flowing from the lateral wellbore 124 should be controlled, reduced, or terminated. This determination can be made, for example, upon a threshold water cut of the fluid flowing into the installable assembly, the installable assembly 220 (e.g., the inflow control device) is run in hole and inserted into the partitioned dual flow mandrel 160 to control the fluid flow received from the lateral wellbore 124. In some systems, the installable assembly can be installed riglessly using coil tubing, a slickline, or an e-line.

An installation method for implementing the system 100, or a similar system, includes two stages. The method is described with reference to the system 100, however, the method may can be used with any applicable system.

A first stage of the installation method involves installing a mechanical, passive dual flow mandrel, for example the partitioned mandrel 160, into a multi-segment wellbore 120. The installation of the passive, dual-flow mandrel 160 includes deploying a first and second packer 144, 146 in the wellbore 120 with the pipeline 130. The first and second packers 144, 146 are deployed at an axial location in the wellbore 120 such that the first packer 144 is arranged uphole of a lateral wellbore opening 128 and the second packer 146 is arranged downhole of the lateral wellbore opening 128. The packers 144, 146 isolate an annulus of the wellbore arranged between the casing 121 and the pipeline 130. The annulus can be the mandrel region 150. The annulus of the wellbore downhole of the second packer 146 (e.g., the downhole region 140) is fluidly connected to the surface by the pipeline 130 and the dual flow mandrel 160.

Production operations can then proceed while the passive completion 100 is in place. Fluid from the downhole region 140 flows through to the first section 132 of the pipeline 130 via the bypass channel 206 or the central channel 204 of the mandrel 160 installed in the mandrel section 134 of the pipeline 130. The fluid from the lateral wellbore 124 can flow to the first section 132 of the pipeline 130 via the inflow channel 208 then the central channel 204.

A second stage of installation involves installing intelligent equipment (e.g., an installable assembly) into the wellbore 120 after a determination that the downhole sensing and control is needed or will be needed in the near future.

To sense and control fluid flow from the lateral wellbore 124, the installable assembly 220 can be riglessly installed, mounted, attached, or integrated into the central channel 204 of the dual flow mandrel 160. The installable assembly is by connected to a slickline, or suitable deployment string like coil tubing or e-line, and run-in-hole to the depth of the dual flow mandrel body 162, for example at a depth in the wellbore 122 such that the installable assembly 220 is aligned with the radial openings 199 of the barrel of the dual flow mandrel 160. The installable assembly 220 includes seals 224 (FIG. 7B) that arranged uphole and downhole of the radial openings 199. In this configuration, the radial openings 199 are arranged between the seals 224. The seals 224 form a fluid seal between the inner surface of the barrel 192 and an exterior 225 of the installable assembly 220. The installable assembly 220 is then disconnected from the slickline and the slickline may be removed. The installable assembly 220 remains seated in the central channel 204 of the dual flow mandrel 160.

After installation of the installable assembly 220 into the central channel 204, the seals 224 and the exterior 225 of the installable assembly 220 form a seal and block the passage of downhole fluid through the central channel 204. The second section 136 of the pipeline 130 can maintain fluid connection to the first section 132 of the pipeline 130 by the annular bypass channels 206.

Figure 8:
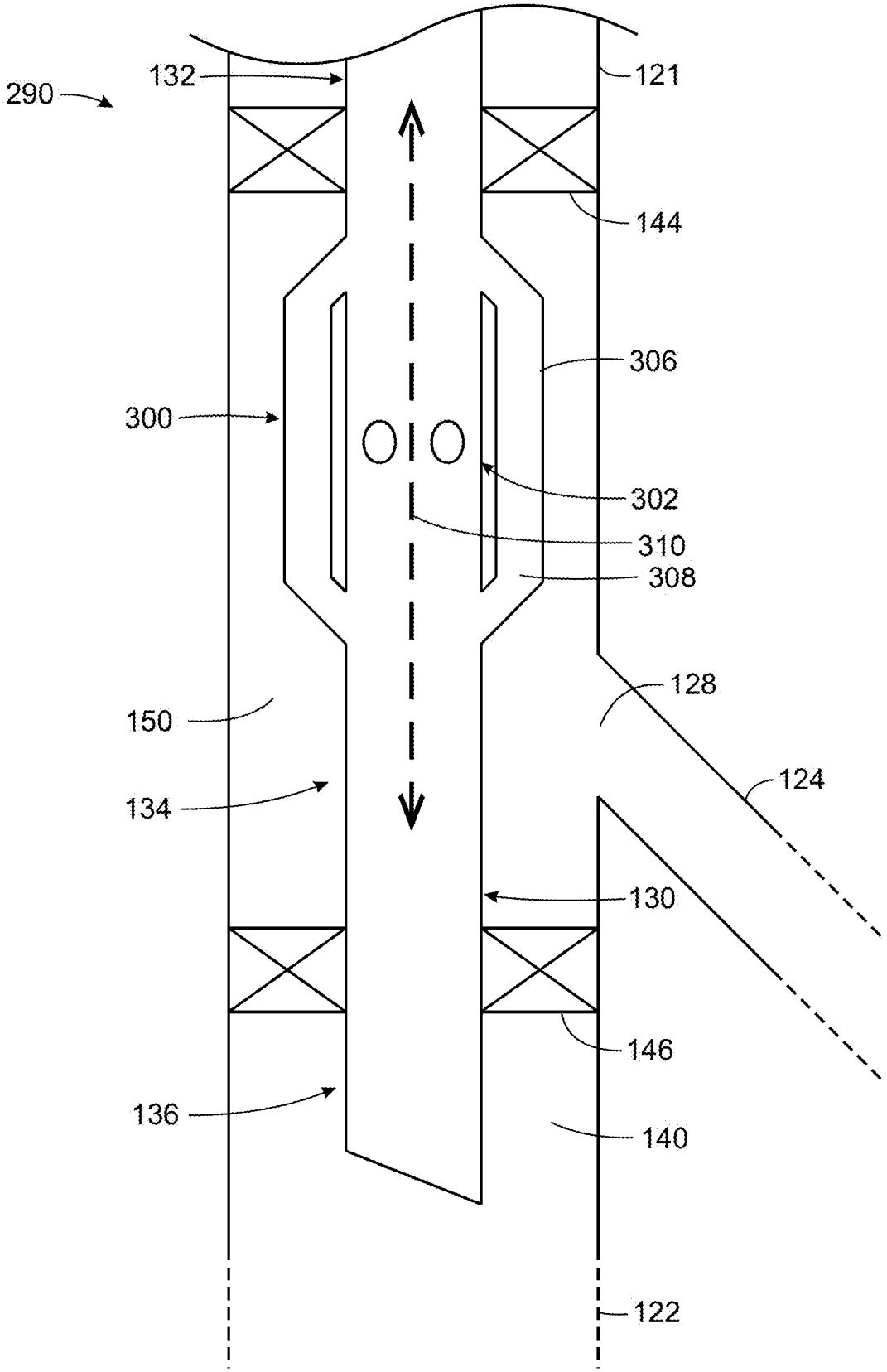
FIG. 8 is a front view of a branched dual flow mandrel deployed in a wellbore.
Figure 9A:
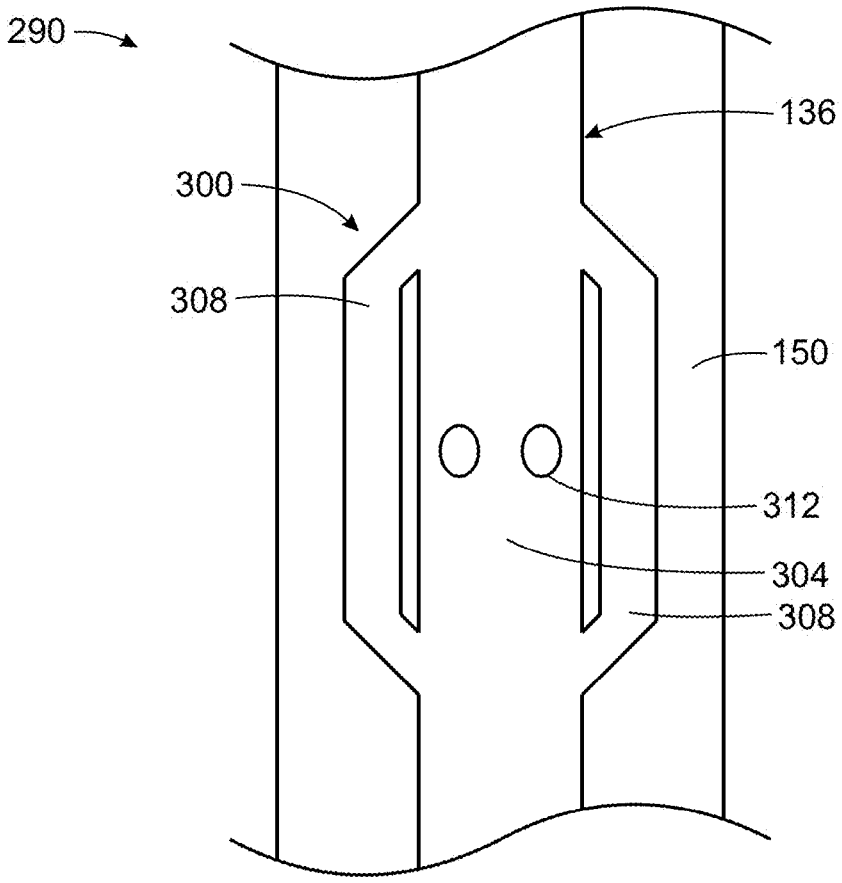
FIGS. 9A and 9B are cross sectional front views of the branched dual flow mandrel prior to and after installation of an inflow control device.

FIG. 8 is front view of a system 290 branched dual flow mandrel 300. The system 290 is substantially similar to the system 100, however, the system 290 includes the branched mandrel 300 with a main body 302 defining a central channel 304 (FIG. 9A) and branch arms 306 defining bypass channels 308 (FIG. 9A). The branch arms 306 are distanced radially from the main body 302. The main body 302 defines a mandrel axis 310.

The main body 302 defines sets of radial ports 312 that fluidly connect the mandrel region 150 (e.g., the environment external to the mandrel section 134 of the pipeline 130) to the central channel 304

Figure 9B:
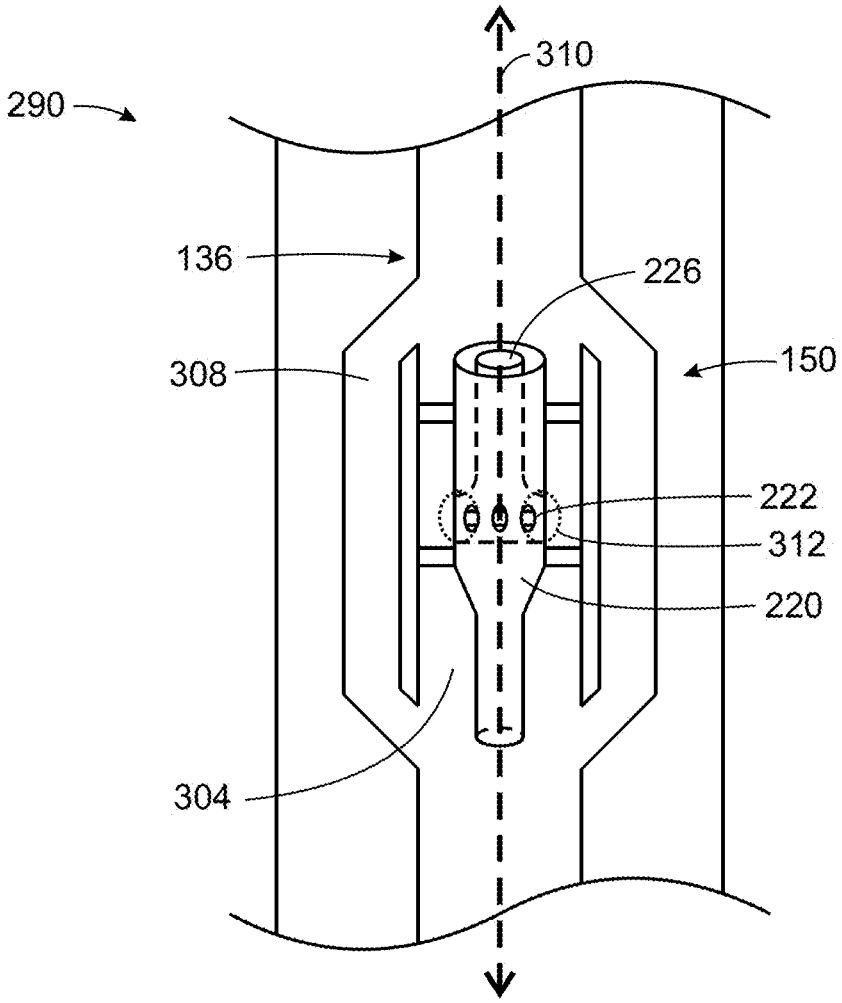

FIGS. 9A and 9B are cross sectional front views of the branched mandrel 300 prior to and after installation of an installable assembly 220, respectively. Prior to retrofitting the completion into an intelligent completion, the central channel 304, with the bypass channels 308, fluidly connect the second section 134 of the pipeline 130 to the first section 132 of the pipeline. The central channel 304 also fluidly connects the mandrel region 150 to the first section 132 of the pipeline 130 by the set of radial ports 312 and the central channel 304.

After installation of the installable assembly 220 in the central channel 304 of the branched mandrel 300 is operable to control the fluid flow the lateral wellbore 124. (FIG. 8). The valves 222 of the installable assembly control the fluid connection between the central channel 204 and the mandrel region 150. The installable assembly 220 also seals the central channel 304 and blocks downhole fluid flow through the central channel 304. The downhole fluid can bypass the installable assembly and central channel 304 thorough the bypass channels 308 defined in the branched arms 306. The bypass channels 308 extend parallel to the mandrel axis 310.

While the dual flow mandrel has been shown in a vertical wellbore with a single lateral (branching) wellbore, the dual flow mandrel can be used in other multi-zone producer and multi-zone injector wells. The completion system can be used in wells with multiple lateral wellbores. In such a case, the completion system can include one or more dual flow mandrels to control the fluid flow at one or more aligned lateral wellbore openings. For example, a completion system can include three passive, dual flow mandrels (e.g., a set of dual flow mandrels). A first dual flow mandrel may be arranged at a first depth so that the first dual flow mandrel is aligned with a first lateral wellbore opening. A second dual flow mandrel may be arranged at a second depth so that the second dual flow mandrel is aligned with a second lateral wellbore opening. A third dual flow mandrel may be arranged at a third depth so that the third dual flow mandrel is aligned with a third lateral wellbore opening. The third depth can be greater than (i.e., deeper) the second depth which is greater than (i.e., deeper) the first depth. The set of dual flow mandrels may be inserted as a pre-manufactured sub-system or may be inserted individually in series, in order of depth within the wellbore.

In this configuration, the third dual flow mandrel controls an annular inflow from the third lateral wellbore and passively permits (uphole) flow from a section of the wellbore downhole of the set of dual flow mandrels. The second dual flow mandrel controls an annual inflow from the second lateral wellbore and passively permits (uphole) flow of the fluid discharged by the third dual flow mandrel (e.g., the fluid from the downhole section with or without the fluid from the third lateral wellbore). The first dual flow mandrel controls an annual inflow form the first lateral wellbore and passively permits (uphole) flow of the fluid discharged by the second dual flow mandrel (e.g., the fluid from the downhole section with or without the fluid from the third lateral wellbore, and with or without the fluid from the second lateral wellbore).

In some cases, the central channels in the set of dual flow mandrels can be different to permit an installable assembly or a body of an installable assembly to pass through the central channel when retrofitting the completion system into an "intelligent" completion system. For example, a first central channel of the first dual flow mandrel may have a greater diameter or cross-sectional area than a second central channel of the second dual flow mandrel. The second central channel of the second dual flow mandrel may have a greater diameter or cross section than a third central channel of the third dual flow mandrel.

In some cases, the set of mandrels each have a central channel with a channel diameter and the installable assembly has expandable seals such that a body of the installable assembly can pass through the central channels when the seals are not actuated. When the seals (or an anchor) are actuated (e.g., by a fluid or electronic signal), the seals (or anchor) expand to mount the body of the installable assembly within the central channel of the corresponding dual flow mandrel.

The system can also include installable assemblies with multiple bodies (e.g., multiple inflow control devices) that can be attached to corresponding dual flow mandrels. Some systems include multiple installable assemblies, each of which are attached to a corresponding dual flow mandrel.

While the system has been described with fluid flowing from the formation (e.g., from the downhole section and/or lateral wellbores) to the surface or uphole sections, the system is also compatible with injection wells in which the fluid flows from the surface, through the completion system, and into the wellbore. Injector completion systems are substantially similar to the previously described completion systems, however, in injector completion systems, the described fluid path is reversed such that the fluid moves from the surface downhole through the completion system. The completion system can then discharge the fluid into the mandrel section of the wellbore or the downhole section of the wellbore. In some cases, the installable assembly, when installed, controls the flow of fluid flow entering the central channel from the first section of the pipeline. The installable assembly may fluidically connect or isolate the first section of the pipeline from the central channel, the annular space, and the wellbore annulus in the mandrel region of the wellbore. The bypass channel continues to passively guide from the first (uphole) section of the pipeline to the second (downhole) section of the pipeline, then through the pipeline opening. The bypass channel maintains passive flow when the installable assembly is not installed and when the installable assembly is installed.

In some cases, the dual flow mandrel can include passive flow control or regulation devices at or between the radial ports of the mandrel body and the radial openings in the barrel of the mandrel partition, to regulate flow between the central channel and the lateral wellbore. Mandrels with passive flow control and regulation devices can passively regulate and control the annular fluid flow from the lateral wellbore before the installation of the installable assembly.

The dual flow mandrels can also include a tracer circuit with a tracer source fluidly connected to the central channel. The tracer (fluid) circuit can be arranged, for example, in the annular space of the dual flow mandrel or in the walls of the mandrel body. The tracer circuit includes a tracer conduit that fluid connects, directly or indirectly, to the central channel. The tracer fluid conduit may have a passive fluid regulator (e.g., a passive control valve, pressure control valve, throttle valve). A tracer fluid (e.g., a tracer chemical, tracer additive) in the tracer fluid source flows at a known (or determinable) rate from the tracer source to the central channel by the tracer conduit. The tracer fluid combines with the annular fluid originating from the lateral wellbore to form a mixed fluid. The tracer in the mixed fluid can be analyzed at the surface to determine the need to actively control the fluid flowing from the lateral wellbore with an installable assembly and/or the type of installable assembly to be used. Where the system has multiple mandrels, a unique tracer can be used in corresponding tracer circuit in each mandrel. The combination of tracers and/or presence of tracers can be analyzed at the surface to identify the need for an installable assembly in each mandrel.

In some cases, the dual flow mandrel is deployed by a rig.

A number of embodiments of the invention have been described. Nevertheless, it will be understood that various modifications may be made without departing from the spirit and scope of the disclosure. Accordingly, other embodiments are within the scope of the following claims.

What is claimed is:

1. A system comprising:

a pipeline having a first section, a second section, and a mandrel section between the first section and second section, a dual flow mandrel arranged in the mandrel section of the pipeline, the dual flow mandrel comprising:

a cylindrical mandrel body comprising:

a first end, a second end, a mandrel axis defined by the first end and the second end of the mandrel body, a wall extending from a first end to a second end of the mandrel body, the wall having an interior surface defining an interior volume of the mandrel body, and a set of radial ports defined in the wall between the first end and the second end; and a mandrel partition arranged in the interior volume of the mandrel body, wherein the mandrel partition comprises:

a barrel arranged on the mandrel axis and extending along the mandrel axis from the first end of the mandrel body to the second end of the mandrel body, the barrel having an inner face and an outer face, wherein the inner face defines a central channel, wherein the central channel fluidly connects to the first section of the pipeline;

a set of radial openings defined in the barrel, wherein the set of radial openings defined in the barrel radially align with the set of radial ports defined in the wall;

at least two flanges protruding radially from the barrel and extending longitudinally along the outer face of the barrel, wherein the flanges contact the interior surface of the body; and an installable assembly comprising an inflow control device arranged in the central channel of the mandrel partition, wherein the outer face of the barrel and the interior surface of the body define an annular space, wherein the at least two flanges partition the annular space into at least two annular channels.

2. The system according to claim 1, wherein the at least two annular channels comprise a first annular channel and a second annular channel fluidically isolated from the first annular channel, wherein the first annular channel is aligned with the set of radial ports of the mandrel body and a second annular channel is isolated from the radial ports of the mandrel body by the at least two flanges.

3. The system according to claim 1, wherein the contact between the at least to flanges of the mandrel partition and the interior surface of the mandrel body forms a fluid seal.

4. The system according to claim 1, wherein the inner surface of the mandrel body defines at least two grooves, each of the at least two grooves sized to receive a corresponding flange of the at least two flanges.

5. The system according to claim 1, wherein the inflow control device is operable to control the flow of a fluid from a lateral wellbore opening.

6. The system according to claim 1, wherein the inflow control device comprises a seal arrangement and at least one inflow control valve.

7. The system according to claim 1, wherein the central channel of the mandrel partition has a proximal end and a distal end, wherein the inflow control device fluidically isolates proximal end of the central channel from the distal end of the central channel.

8. The system according to claim 7, wherein the central channel comprises an inflow section arranged between the proximal end and the distal end, wherein a radial opening defined in the barrel aligns with the inflow section of the central channel.

9. The system according to claim 8, wherein the inflow control device fluidically isolates the inflow section of the central channel from the distal end of the central channel.

10. The system according to claim 9, wherein the proximal end of the central channel fluidly connects to the first section of the pipeline.

11. The system according to claim 1, further comprising a first packer and a second packer, wherein the mandrel section is defined between the first packer and second packer.

12. The system according to claim 1, wherein the mandrel section is aligned with a lateral wellbore opening.

13. The system according to claim 1, wherein the at least two flanges comprise a first flange, a second flange, a third flange and a fourth flange that each extend from the outer face of the barrel and extend longitudinally along the outer surface of the barrel from the first end to the second end of the barrel.

14. The system according to claim 13, wherein the first flange, second flange, third flange, and fourth flange, form at least four annular channels in the annular space of the dual flow mandrel.

15. The system according to claim 14, wherein the at least four channels include a lateral flow channel and a bypass flow channel, wherein the set of radial ports in the wall of the mandrel body fluidly connect the lateral flow channels to the environment external to the dual flow mandrel.

16. The system according to claim 14, wherein the lateral flow channel is fluidly connected to the central channel by the radial opening defined in the barrel.

17. The system according to claim 16, wherein the bypass flow channel fluidly connects the second section of the pipeline to the first section of the pipeline, wherein the inner surface of the wall of the mandrel body at least partially defining the bypass channel fluidically isolates the bypass channel from the environment external to the dual flow mandrel.

18. The system according to claim 16, wherein the outer face of the barrel at least partially defining the bypass channel fluidically isolates the bypass channel from the central channel.

19. The system according to claim 16, wherein the at least two flanges fluidically isolate the bypass channel from the lateral flow channel.

20. The system according to claim 14, wherein the set of radial ports is a first set of radial ports, further comprising a second set of radial ports defined in the wall of the mandrel body, wherein the first set and second set of radial ports are equidistant on the mandrel body, relative to each other.

21. The system according to claim 20, wherein the second set of radial ports is fluidly connected to the central channel.

22. The system according to claim 1, wherein the central channel fluidly connects a lateral wellbore opening to the first section of the pipeline.

23. The system according to claim 1, wherein at least two flanges are arranged equidistant around the outer face of the barrel.

24. A system comprising:

a pipeline having a first section, a second section, and a mandrel section between the first section and second section, a dual flow mandrel arranged in the mandrel section of the pipeline, the dual flow mandrel comprising:

a cylindrical mandrel body comprising:

a first end, a second end, a mandrel axis defined by the first end and the second end of the mandrel body, a wall extending from a first end to a second end of the mandrel body, the wall having an interior surface defining an interior volume of the mandrel body, and a set of radial ports defined in the wall between the first end and the second end; and a mandrel partition arranged in the interior volume of the mandrel body, wherein the mandrel partition comprises:

barrel arranged on the mandrel axis and extending along the mandrel axis from the first end of the mandrel body to the second end of the mandrel body, the barrel having an inner face and an outer face, wherein the inner face defines a central channel, wherein the central channel fluidly connects to the first section of the pipeline; and at least two flanges protruding radially from the barrel and extending longitudinally along the outer face of the barrel, wherein the flanges contact the interior surface of the body;

wherein the outer face of the barrel and the interior surface of the body define an annular space, wherein the at least two flanges partition the annular space into at least two annular channels, wherein the inner surface of the mandrel body defines at least two grooves, each of the at least two grooves sized to receive a corresponding flange of the at least two flanges.

* * * * *